US009511296B2

(12) United States Patent
Bertschy

(10) Patent No.: US 9,511,296 B2
(45) Date of Patent: Dec. 6, 2016

(54) SWING WITH ADJUSTABLE HANDLE

(71) Applicant: Robert R. Bertschy, John's Island, SC (US)

(72) Inventor: Robert R. Bertschy, John's Island, SC (US)

( * ) Notice: Subject to any disclaimer, the term of this patent is extended or adjusted under 35 U.S.C. 154(b) by 0 days.

(21) Appl. No.: 15/044,304

(22) Filed: Feb. 16, 2016

(65) Prior Publication Data

US 2016/0279530 A1 Sep. 29, 2016

Related U.S. Application Data

(60) Provisional application No. 62/136,856, filed on Mar. 23, 2015.

(51) Int. Cl.

| | |
|---|---|
| ***A63G 9/14*** | (2006.01) |
| ***A63G 9/00*** | (2006.01) |
| *A47D 13/00* | (2006.01) |

(52) U.S. Cl.

CPC ..... *A63G 9/00* (2013.01)

(58) Field of Classification Search

CPC ..... A63G 9/00; A63G 9/14; A63G 13/00; A63G 13/02; A47D 13/00; A47D 13/05

USPC ..... 472/118–125; 297/273, 274, 284

See application file for complete search history.

(56) References Cited

U.S. PATENT DOCUMENTS

| | | | | |
|---|---|---|---|---|
| 1,914,555 A | | 6/1933 | Connelly | |
| 1,924,683 A | * | 8/1933 | Fletcher | A47D 13/105 472/122 |
| 3,298,738 A | * | 1/1967 | Shalhoob | A63G 9/00 297/273 |
| D253,362 S | | 11/1979 | Dieter et al. | |
| 4,289,310 A | | 9/1981 | Weakly | |
| D274,450 S | | 6/1984 | Gordon | |
| 4,524,966 A | | 6/1985 | Shannon et al. | |
| D281,447 S | | 11/1985 | Gordon | |
| 4,575,073 A | | 3/1986 | Thacker | |
| 5,067,706 A | * | 11/1991 | Tsai | A63G 9/00 472/118 |
| D340,275 S | | 10/1993 | Haun | |
| D343,671 S | | 1/1994 | Smith | |
| D355,013 S | | 1/1995 | Schechner | |
| D520,591 S | | 5/2006 | Popp | |
| 8,672,770 B2 | * | 3/2014 | Matt | A63G 9/14 472/118 |
| D728,721 S | | 5/2015 | Diego | |

OTHER PUBLICATIONS

Citation of Related Applications.

* cited by examiner

*Primary Examiner* — Kien Nguyen

(74) *Attorney, Agent, or Firm* — JK Intellectual Property Law, PA

(57) ABSTRACT

A swing assembly may include a base having a center portion and two side portions on opposite sides of the center portion, two supports attached to the base, each support being attached to a respective side portion so that the base may be hung by the supports. Each support may include two spaced elongated members. Two handles may be movably attached to the supports, each handle including a body and two pairs of openings extending through the body. Each pair of openings may receive one of the elongated members in a spiral configuration so that the respective handle body may be slid up or down the elongated members to a desired height relative to the base.

17 Claims, 6 Drawing Sheets

20

20

SWING WITH ADJUSTABLE HANDLE

CROSS-REFERENCE TO RELATED APPLICATIONS

This application claims filing benefit of U.S. Provisional Patent Application Ser. No. 62/136,856 having a filing date of Mar. 23, 2015, which is incorporated herein by reference in its entirety.

TECHNICAL FIELD

The present disclosure relates to a swing. More particularly, the present invention relates to a swing with an adjustable handle.

BACKGROUND

Swings have been used for many years for entertainment and exercise. Many swings include a base portion that is sat upon and one or more ropes on each side to support the base portion. The ropes are tied to a tree or artificial structure. Typically, a user sits on the base between the ropes and holds on to the ropes with his or her hands. By leaning alternatingly backward and forward while pulling or pushing on the ropes, the user can generate enough force to start the forward and back pendulum-like movement of the swing.

While such swings have been in use for many years, improvements that provide a faster, more exciting ride would be welcome. Also, a swing with improved handles that provide a more secure and adjustable grip for a user would also be welcome.

SUMMARY

According to certain aspects of the disclosure, a swing assembly may include a base having a center portion and two side portions on opposite sides of the center portion, two supports attached to the base, each support being attached to a respective side portion so that the base may be hung by the supports. Each support may include two spaced elongated members. Two handles may be movably attached to the supports, each handle including a body and two pairs of openings extending through the body. Each pair of openings may receive one of the elongated members in a spiral configuration so that the respective handle body may be slid up or down the elongated members to a desired height relative to the base. Various options and modifications are possible.

According to certain other aspects of the disclosure, a swing assembly may include a base having a center portion and two side portions on opposite sides of the center portion, the side portions extending upwards from the center portion in a direction away from the center portion, and two supports attached to the base. Each support may be attached to a respective side portion so that the base may be hung by the supports. Each support may include two spaced elongated members attached to the base at a point along the base at which the side portions are angled about 15 degrees to about 40 degrees relative to the center of the base. Two handles may be movably attached to the supports, each handle including a body and two pairs of openings extending through the body. Each pair of openings may receive one of the elongated members in a spiral configuration whereby each elongated member extends upwards through a first opening in the respective pair, then down and around an outer side of the handle body, then upwards through a second opening in the respective pair so that the respective handle body may be slid up or down the elongated members to a desired height relative to the base. Various options and modifications are possible.

BRIEF DESCRIPTION OF THE DRAWINGS

More details of the present disclosure are set forth in the drawings.

DETAILED DESCRIPTION

Figure 1:
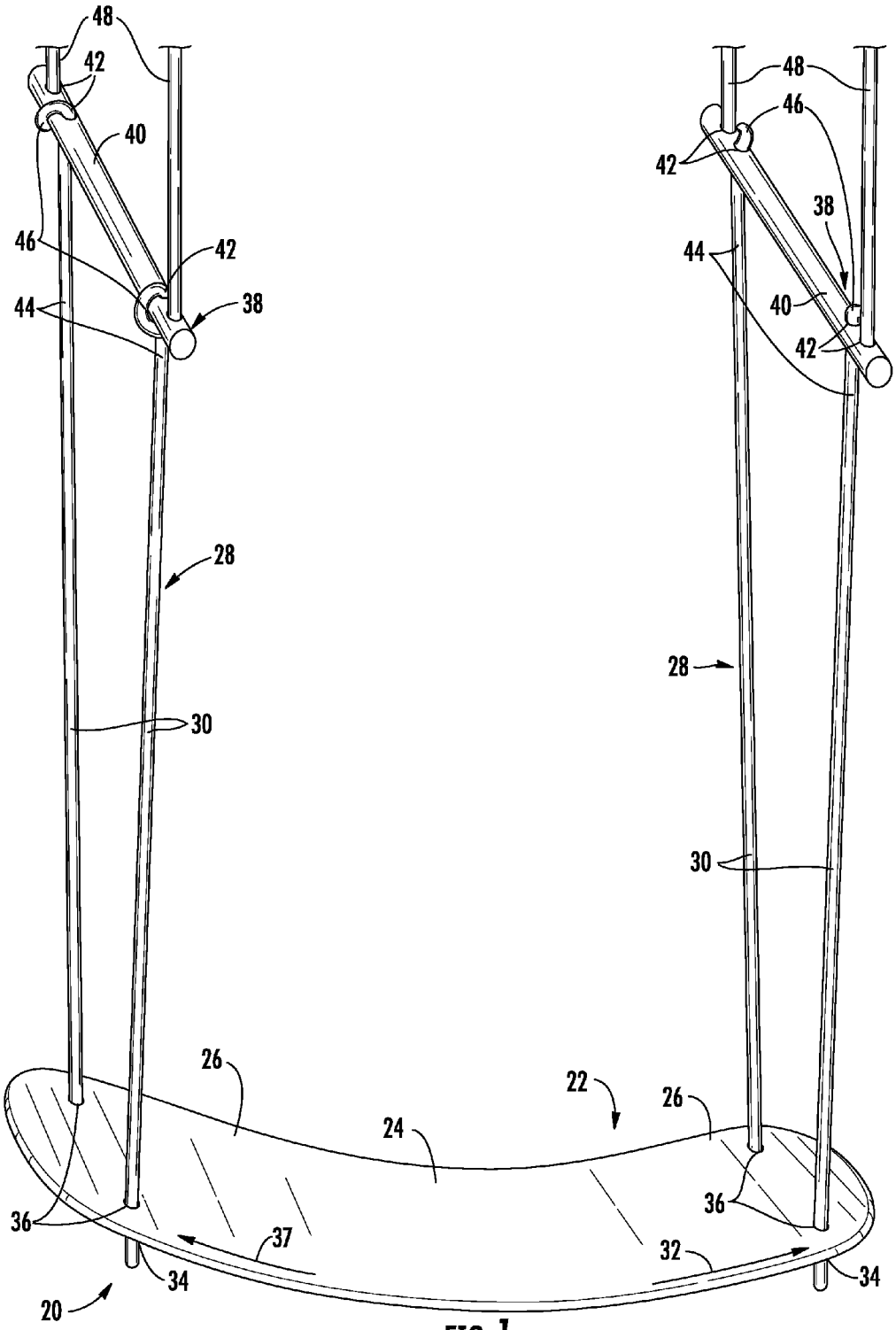
FIG. 1 is a front isometric view of a swing assembly according to certain aspects of the present disclosure.
Figure 2:
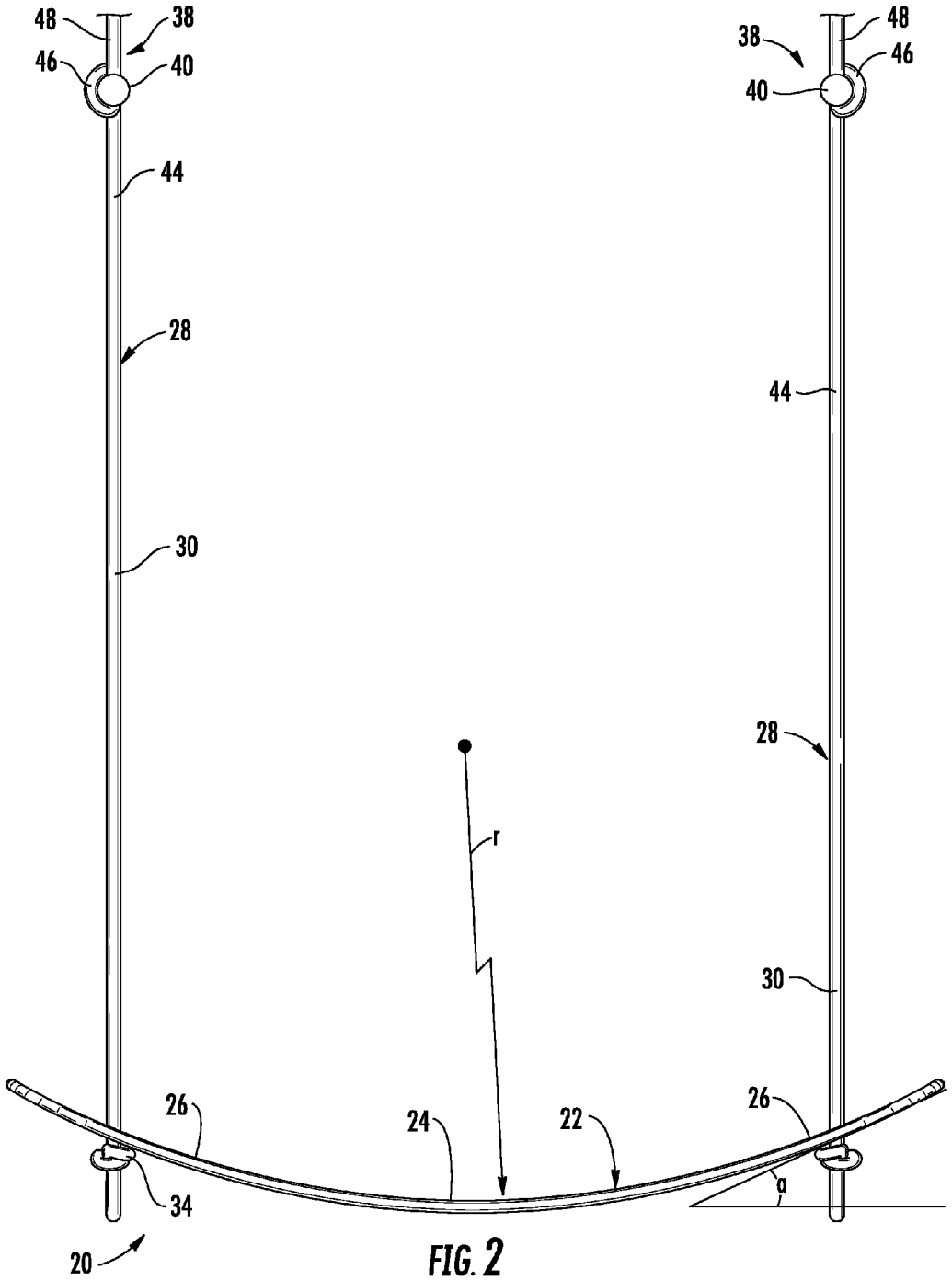
FIG. 2 is a front view of the swing assembly of FIG. 1.
Figure 3:
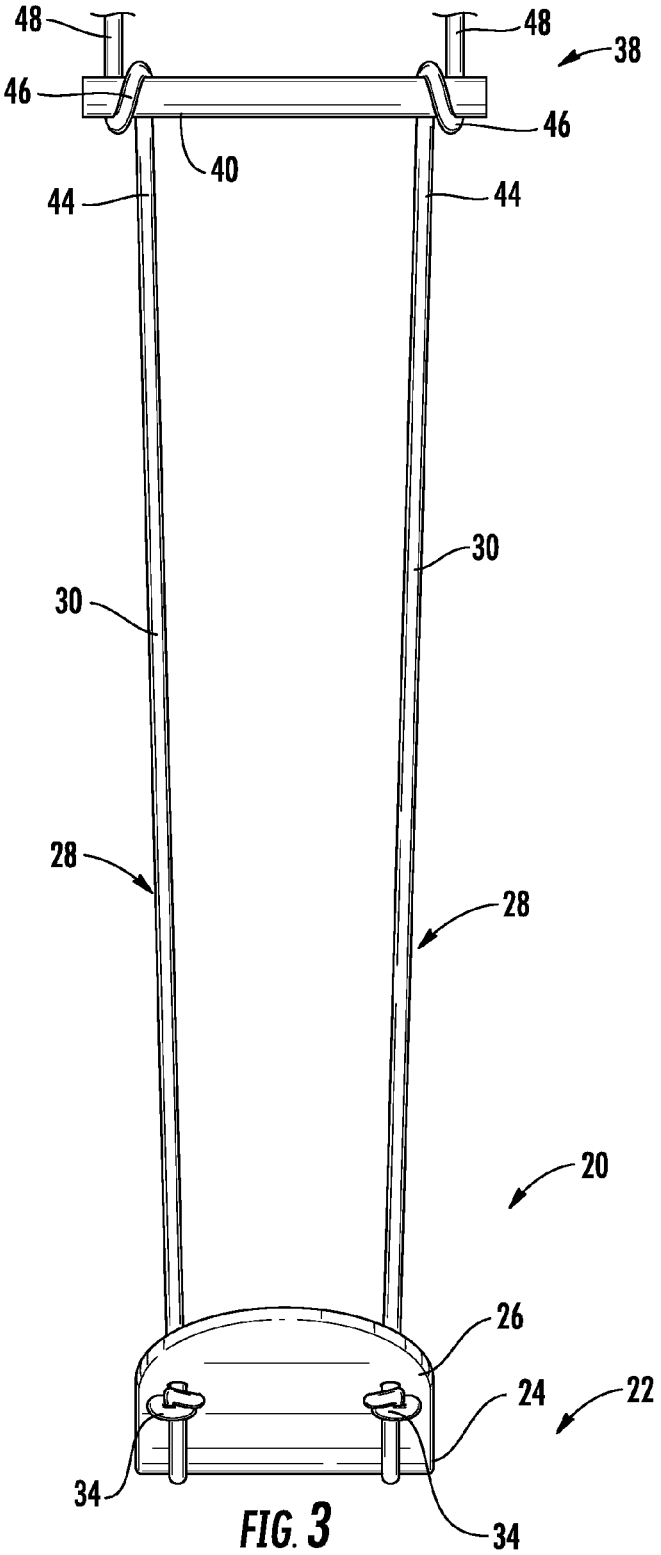
FIG. 3 is a right or left side view of the swing assembly of FIG. 1.
Figure 4:
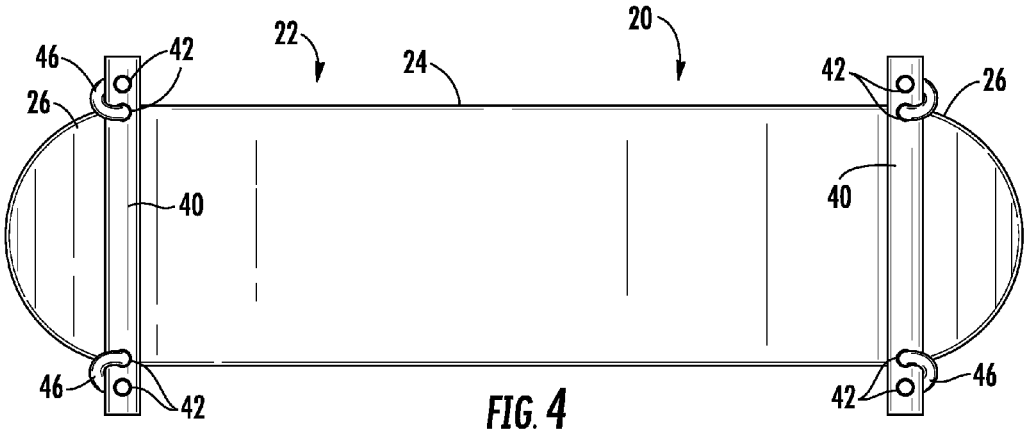
FIG. 4 is a top view of the swing assembly of FIG. 1.
Figure 5:
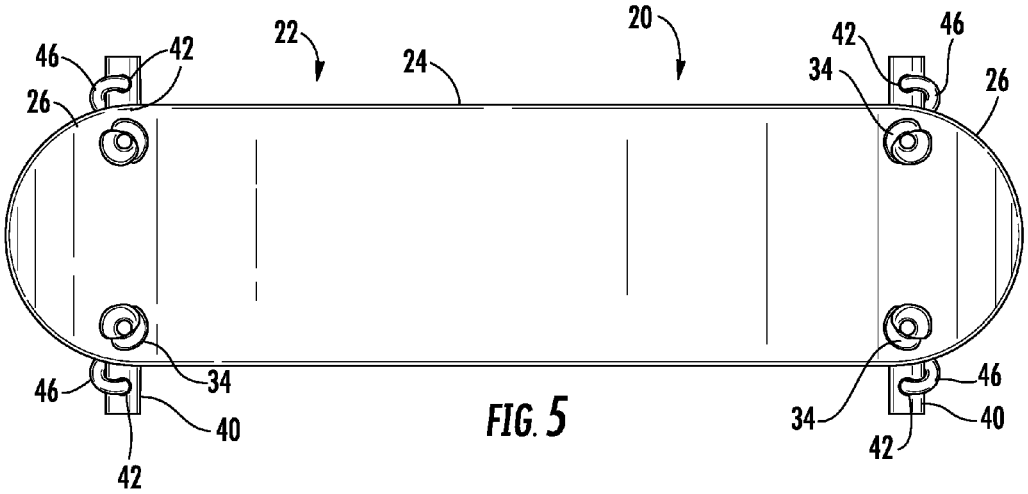
FIG. 5 is a bottom view of the swing assembly of FIG. 1.
Figure 6:
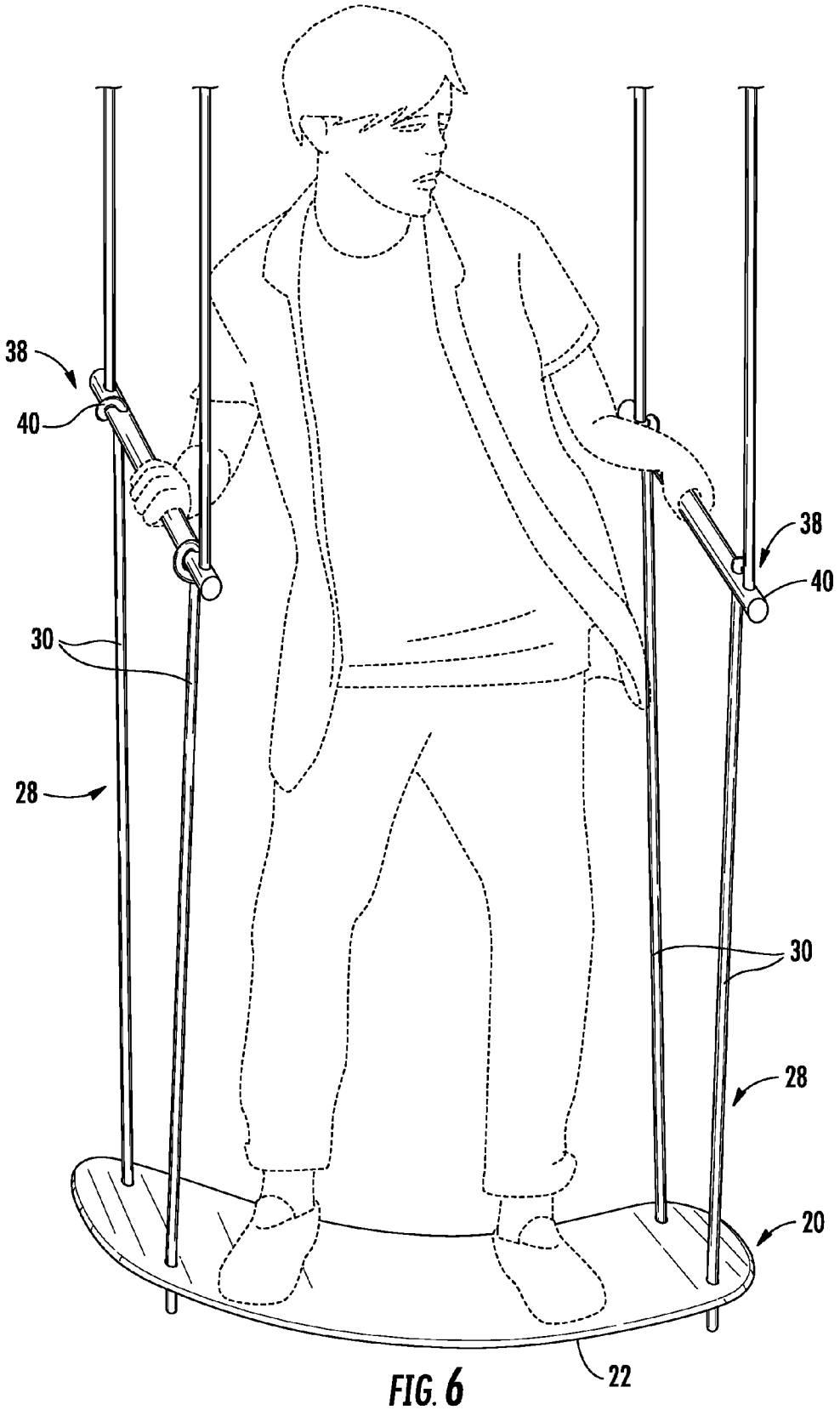
FIG. 6 is a front isometric view of the swing assembly of FIG. 1, also showing a user.

Detailed reference will now be made to the drawings in which examples embodying the present disclosure are shown. The detailed description uses numeral and letter designations to refer to features in the drawings. Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

Generally speaking, FIGS. 1-10 show an example of a swing assembly 20 including a base 22 having a center portion 24 and two side portions 26 on opposite sides of the center portion. Side portions 26 extend upwards from center portion 24 in a direction 32 away from the center portion.

Base 22 may be made of a laminated wood construction, if desired. Alternatively, base 22 made be made of other suitable materials such as metals, plastics, etc. that can support the weight of a user and bear the forces imposed on the base by virtue of the use of the swing assembly.

Two supports 28 are attached to base 22. Each support 28 may comprise two elongated members 30 that are attached to base 22 via openings 36 in base. If desired, the two elongated members 30 attached to each side portion 26 may be separate ropes, as shown, with securing portions 34 (such as knots, loops, other members, etc.) on the bottom of base 22 to hold the elongated members to the base. Alternatively, elongated members 30 could be instead formed unitarily, for example, in a "U shape" with the arms of the "U extending upward from base 22 and with the base of the "U" extending along the underside of the base between openings 36.

Elongated members may 30 be at least ten feet long, preferably longer, to allow a user to swing on the swing assembly.

Regardless of the form of the supports 28, each support is attached to a respective side portion 26 so that base 22 may be hung by the supports. Supports 28 are attached to base 22 at a point (along the base where openings 36 are located) at which side portions 26 extend upwardly relative to center portion 24 of the base. The upward angle a of side portions 26 provides a bearing surface that a user can use to help steady himself or herself on base 22, and to create swinging motion. The upward angle a of side portions 26 adjacent openings 36 relative to the substantially horizontal middle of center portion 24 may be about 15 degrees to about 40 degrees, or of about 30 degrees.

Two handles 38 are movably attached to supports 28. Each handle 38 includes a body 40 and two pairs of openings 42 extending through the body. If desired, the openings 42 within each pair may extend substantially parallel to each other through handle body 40.

Each pair of openings 42 receives one of the elongated members 30 in a spiral configuration. For example, each elongated member 30 may have a first portion 44 extending upwards through a first opening 42, a second portion 46 that extends down and around an outer side of the handle body 40, and a third portion 48 that extends upwards through a second opening 42. Such arrangement allows the handle body 40 to be slid up or down elongated members 30 to a desired height relative to base 22. Such adjustability can improve the safety or comfort of a user, at least in part in view of the height of the user.

If desired, the center portion 24 and side portion 26 of the base 22 may form a continuous curve. If so, the continuous curve may have a radius of curvature r of about 2.5 feet to about 4.0 feet, or of about 3.0 feet. However, the curvature along base 22 need not be continuous. Also, flat portions may be included, and portions of differing radius of curvature may be included. Alternately, flat portions connected by angled portions that are not substantially curved may also be included. Thus, upwardly angled or curved side portions 26 are not required in all aspects of the invention, nor are curved or continuously curved shapes for base 22.

Figure 7:
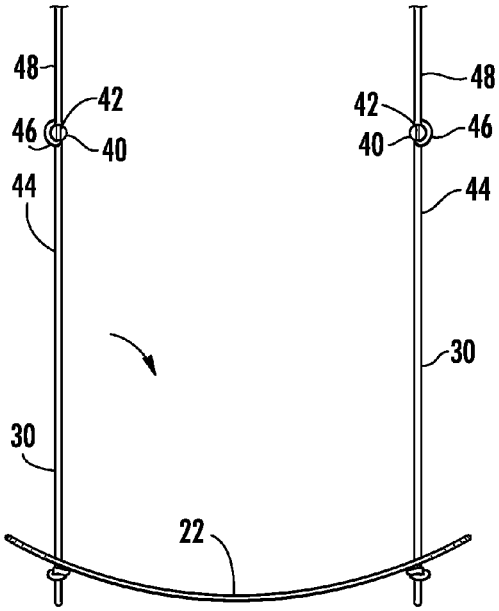
FIGS. 7 and 8 are diagrammatical front views of the swing assembly showing adjustability of the handles relative to the swing base.
Figure 8:
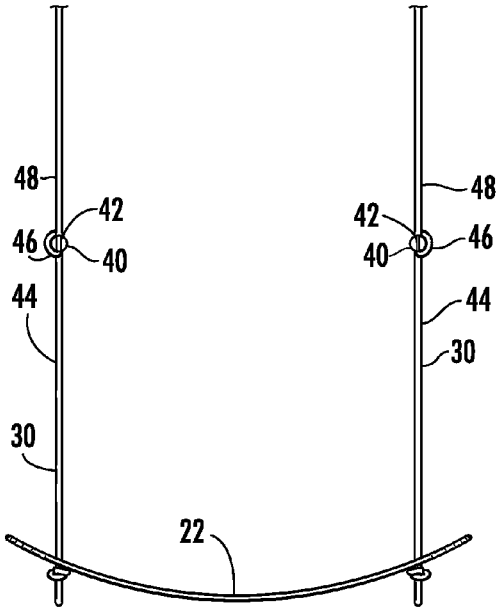

FIGS. 7 and 8 show diagrammatically handle bodies 40 being moved from a first, lower position (FIG. 7) to a second, higher position (FIG. 8) with reference to base 22. Handle bodies 40 are held substantially in place via friction, looping of the elongated members 30 in a spiral fashion around the bodies, and/or by use of two openings 42 at each end of the bodies (rather than just one without looping).

Figure 9:
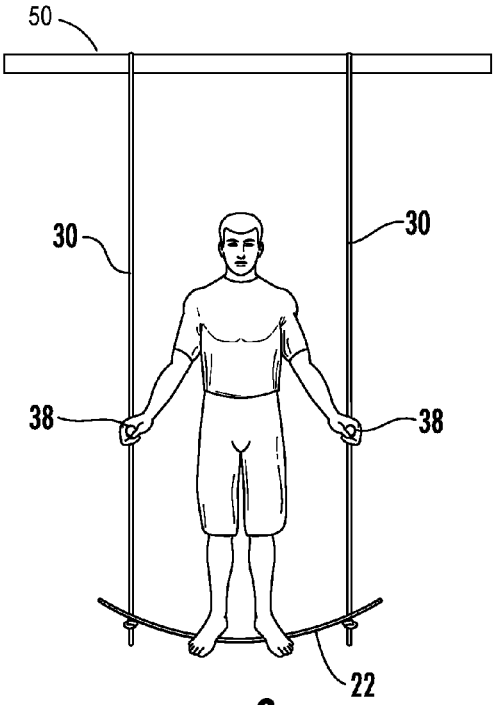
FIGS. 9 and 10 are diagrammatic front views of the swing assembly showing movement from a central location to an outer location caused by a user using the swing assembly.
Figure 10:
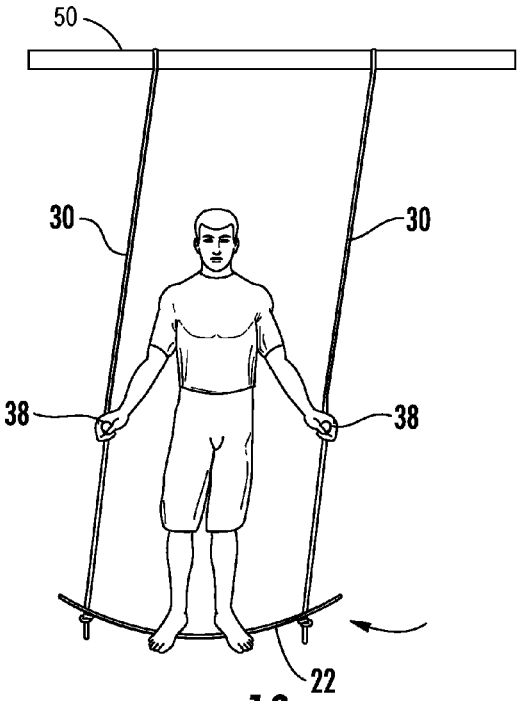

FIGS. 9 and 10 show diagrammatically swing 20 being swung from a support 50 laterally from a first, central position (FIG. 9) to a second, lateral position (FIG. 10). The ability of the user to place handle bodies 40 as desired relative to base may assist in achieving lateral swinging motion. Also, the upwardly angled side portions 26 may also assist the user in achieving the lateral swinging motion. By adjusting his or her weight and pulling or pushing on handles 40, a user may freely swing as desired laterally, back and forth, in curved shapes or overlapping patterns, etc., in ways not possible with conventional swings where a user typically simply moves back and forth while seated.

While preferred embodiments of the disclosure have been described above, it is to be understood that any and all equivalent realizations of the present disclosure are included within the scope and spirit thereof. Thus, the embodiments depicted are presented by way of example only and are not intended as limitations upon the present disclosure. While particular embodiments of the disclosure have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

I claim:

1. A swing assembly comprising:

a base having a center portion and two side portions on opposite sides of the center portion;

two supports attached to the base, each support being attached to a respective side portion so that the base may be hung by the supports, each support including two spaced elongated members; and two handles movably attached to the supports, each handle including a body and two pairs of openings extending through the body, each pair of openings receiving one of the elongated members in a spiral configuration so that the respective handle body may be slid up or down the elongated members to a desired height relative to the base.

2. The swing assembly of claim 1, wherein the side portions extend upwards from the center portion in a direction towards a point where the supports are attached to the base.

3. The swing assembly of claim 2, wherein the side portions are angled at about 15 degrees to about 40 degrees relative to the center portion of the base adjacent the point where the supports are attached to the base.

4. The swing assembly of claim 2, wherein the center portion and the side portion of the base form a continuous curve.

5. The swing assembly of claim 4, wherein the continuous curve has a radius of curvature of about 2.5 feet to about 4.0 feet.

6. The swing assembly of claim 1, wherein each elongated member comprises a rope.

7. The swing assembly of claim 6, wherein each rope includes a securing portion on a bottom side of the base.

8. The swing assembly of claim 7, wherein the securing portion is a knot.

9. The swing assembly of claim 1, wherein each elongated member extends upwards through a first opening in the respective pair, then down and around an outer side of the handle body, then upwards through a second opening in the respective pair.

10. The swing assembly of claim 1, wherein the openings within a pair of openings in the handle body extend through the handle parallel to each other.

11. The swing assembly of claim 10, wherein each elongated member comprises a rope.

12. The swing assembly of claim 11, wherein each rope includes a securing portion on a bottom side of the base.

13. The swing assembly of claim 11, wherein the securing portion is a knot.

14. The swing assembly of claim 10, wherein the openings within a pair of openings in the handle body extend through the handle parallel to each other.

15. A swing assembly comprising:

a base having a center portion and two side portions on opposite sides of the center portion, the side portions extending upwards from the center portion in a direction away from the center portion;

two supports attached to the base, each support being attached to a respective side portion so that the base may be hung by the supports, each support including two spaced elongated members attached to the base at a point along the base at which the side portions are angled about 15 degrees to about 40 degrees relative to the center portion of the base; and two handles movably attached to the supports, each handle including a body and two pairs of openings extending through the body, each pair of openings receiving one of the elongated members in a spiral configuration whereby each elongated member extends upwards through a first opening in the respective pair, then down and around an outer side of the handle body, then upwards through a second opening in the respective pair so that the respective handle body may be slid up or down the elongated members to a desired height relative to the base.

16. The swing assembly of claim 15, wherein the center portion and the side portion of the base form a continuous curve.

17. The swing assembly of claim 16, wherein the continuous curve has a radius of curvature of about 2.5 feet to about 4.0 feet.

* * * * *